US006199828B1

(12) United States Patent
Komperud

(10) Patent No.: US 6,199,828 B1
(45) Date of Patent: Mar. 13, 2001

(54) LINEAR SPREADER

(76) Inventor: Dennis A. Komperud, 704 N. 7th, Comanche, OK (US) 73529

( * ) Notice: Subject to any disclaimer, the term of this patent is extended or adjusted under 35 U.S.C. 154(b) by 0 days.

(21) Appl. No.: 09/412,393

(22) Filed: Oct. 5, 1999

(51) Int. Cl.[7] ..... B66F 3/36
(52) U.S. Cl. ..... 254/100
(58) Field of Search ..... 254/100, 98, 133 R, 254/133 A, 134, DIG. 4; 269/69

(56) References Cited

U.S. PATENT DOCUMENTS 826,124 * 7/1906 Soseman ..... 254/100
5,087,019 * 2/1992 Peabody et al. ..... 254/100

FOREIGN PATENT DOCUMENTS

162231 * 9/1933 (CH) ..... 254/98

* cited by examiner

*Primary Examiner*—Robert C. Watson

(57) ABSTRACT

This invention provides a tool and a method of using the tool to spread linearly spaced objects apart. The tool is positioned between the spaced objects and then operated by mechanical action to generate compressive forces which act against the spaced objects to cause the linear separation between the objects to increase. The objects to be separated can be horizontally or vertically spaced and each can be movable or one can be stationary and the other can be movable.

12 Claims, 4 Drawing Sheets

LINEAR SPREADER

BACKGROUND OF THE INVENTION

1. Field of the Invention

This invention broadly relates to methods of and apparatus for increasing the distance between solid objects. The invention further relates to methods of and apparatus for increasing the linear separation between adjacent solid objects. The invention more particularly relates to a portable mechanical apparatus for increasing the linear separation between adjacent solid objects by generating compressive force sufficient to overcome forces which act to maintain the objects in an initial position.

2. Related Art and Problem Solved

Persons engaged in building or repairing structures, such as a building or a mechanical system, are often confronted with a condition associated with the linear spacing between adjacent objects in the structure. In one aspect of the condition, the distance between the spaced objects is less than some desired amount, wherein the distance is maintained by the shear mass of the objects or by some exterior force acting on the objects or by some combination thereof. Thus, the problem to be solved caused by the mentioned condition involves increasing the linear distance between the objects by overcoming the forces which maintain the objects in position. The solutions have been to pull the objects apart or to push the objects apart. The solution provided by this invention is a tool which is placed between the objects and which can then be operated to generate sufficient force to push the objects apart.

Portable tools for and methods of using the tools to increase the separation between solid objects by gradually pushing them apart are well known in the art. One such tool, especially one employed to raise heavy objects, such as vehicles, over a short distance is commonly referred to as a "jack." It is well known that a jack can be comprised of a rising piston, platform or shelf which is driven by hydraulic pressure or by a lever and ratchet mechanism. Furthermore, a jack can be comprised of a scissor or jaws device driven by a rotatable threaded shaft or by hydraulic pressure. It is known that a jack is generally limited to moving an object in a vertical direction away from a stationary object, such as ground.

A tool useful to gradually spread objects which are horizontally spaced apart and held in such condition by exterior forces, as exemplified by beams and joists in a building or structure, has not been provided by the prior art. In this regard, such beams have been spread by wedging braces of fixed length between the beams by the use of uncontrolled and variable force, such as by hammering.

Accordingly, an apparatus and a method of using the apparatus to evenly and gradually apply compressive force in amount sufficient to separate horizontally oriented objects as well as to lift and/or separate vertically oriented objects has not been provided by the prior art. Such an apparatus and method of using the same is provided by this invention.

SUMMARY OF THE INVENTION

This invention provides an apparatus and a method of using the apparatus to increase the linear separation between opposed objects. In this regard, the apparatus of this invention is sometimes referred to herein as a linear spreader, or, more simply, as a spreader, and the method can be referred to as a method of increasing the linear separation between two objects which occupy adjacent, separate, opposed positions.

The objects to be spread can consist of one substantially stationary object and one movable object or the objects can consist of two movable objects. The objects to be spread, preferably lie in parallel relationship, such as, but not limited to, a vertical parallel relationship or a horizontal parallel relationship. Thus, in one aspect, the spreader can be simply viewed as being a lifting apparatus useful to increase the vertical separation of a movable object with respect to a substantially stationary position, such as ground. In another aspect, the invention can be viewed in more complex terms as being an apparatus useful to increase the separation, such as the horizontal separation, between two movable objects, such as adjacent beams, joists or rails in a structure. It is, thus, plain that the mentioned aspects are merely two of a variety of combinations of uses in which the apparatus can be beneficially employed.

The function of the spreader, in each of the various aspects of the separation method, is to apply compressive force to the objects to be separated. It is clear, in the case of two movable objects, that the force applied by the spreader causes each object to move in a linear direction opposite to the other. It is also clear, in the case of a stationary object and a movable object, that the force applied by the spreader causes the movable object to move in a linear direction perpendicular to, and away from, the stationary object. Of course, there is always the potential question of whether each object is, in fact, movable, or whether one is movable and the other stationary, or substantially stationary. It is believed, however, that the answer to the question is, at least, a function of the relative mass of each object and/or the relative exterior forces which act to maintain the resting positions of each object and which oppose the compressive forces generated by the spreader. Obviously, the linear motion produced by the spreader of this invention is in the direction of the path of least resistance. The spreader thus acts with greater efficiency to move the object having the lower relative mass and/or which is influenced by the lower relative exterior force.

The spreader of this invention is especially useful to produce small changes in the linear separation of opposed objects in order to enable the convenient performance of some task or the placement or removal of some part. For example, beams in a structure which are too close together can be spread by the apparatus of this invention to enable the convenient insertion between the beams of a brace which will operate to maintain the beams at some desired separation upon removal of the spreader.

The linear spreader of this invention is an elongated tubular structure comprised of a first object contacting end, a second object contacting end, a linear pressure transmission member positioned intermediate the first object contacting end and the second object contacting end and a force generating member operably connected to the linear pressure transmission member and adapted to produce linear and rotational motion relative to the linear pressure transmission member. The linear pressure transmission member is adapted to transmit compressive force to the first object contacting end and the force generating member is adapted to transmit compressive force to the second object contacting end.

In one embodiment, the first object contacting end of the spreader of this invention can be a stationary linear member having a distal end and a proximal end wherein the distal end is specifically adapted to contact and apply compressive force to a first object. The second object contacting end can be a traveling housing having a distal end and a proximal end wherein the distal end is specifically adapted to contact and apply compressive force to a second object which is physically separated from the first object. The linear pressure transmission member is attached to the proximal end of the stationary linear member to prevent motion of any kind between the stationary linear member and the linear pressure transmission member. The proximal end of the traveling housing is adapted to permit linear motion relative to the linear pressure transmission member and to permit rotational motion relative to the force generating member. The proximal end of the traveling housing is further adapted, upon contact with the force generating member, to prevent linear motion relative to the force generating member.

In one preferred embodiment, the spreader of this invention is an elongated tool comprised of a hollow traveling housing having a first distal end and a first proximal end, a tubular member having a second distal end and a second proximal end, a threaded rod having a free end and a fixed end, and a nut having threads compatible with the threads of the threaded rod. The threaded rod is positioned intermediate the hollow traveling housing and the tubular member. The fixed end of the threaded rod is rigidly connected to the second proximal end of the tubular member to enable the threaded rod to transmit compressive force to the tubular member. The free end of the threaded rod is not connected to, but is merely inserted into the first proximal end of the hollow traveling housing so that the threaded rod can move and/or slide, without obstruction, in the interior of the traveling housing. The nut is threaded on the threaded rod intermediate the hollow traveling housing and the tubular member. The nut is adapted to contact and rotate against the first proximal end of the hollow traveling housing so that the nut can transmit compressive force to the hollow traveling housing.

In another preferred embodiment, the spreader of this invention is an elongated tool comprised of a hollow traveling housing having a first distal end and a first proximal end, a linear member comprised of a tubular member and a hollow stationary housing, a threaded rod having a free end and a fixed end, and a nut having threads compatible with the threads of the threaded rod. The tubular member has a second distal end and a second proximal end. The hollow stationary housing has a third distal end and a third proximal end. The tubular member is slidably inserted and adjustably fixed in the interior of the hollow stationary housing to prevent relative linear motion between the tubular member and the hollow stationary housing. In this embodiment the second proximal end of the tubular member is the primary proximal end of the linear member and the third distal end of the hollow stationary housing is the primary distal end of the linear member.

The threaded rod is positioned intermediate the hollow traveling housing and the tubular member. The fixed end of the threaded rod is rigidly connected to the second proximal end of the tubular member so that the threaded member can transmit compressive force to the linear member. The free end of the threaded rod is not connected to, but is merely inserted into the first proximal end of the hollow traveling housing so that the threaded rod can move and/or slide, without obstruction, in the interior of the traveling housing.

The nut is threaded on the threaded rod intermediate the hollow traveling housing and the tubular member. The nut is adapted to contact and rotate against the first proximal end of the hollow traveling housing so that the nut can transmit compressive force to the hollow traveling housing.

DESCRIPTION OF THE PREFERRED EMBODIMENTS

Structure of the Invention

Figure 1:
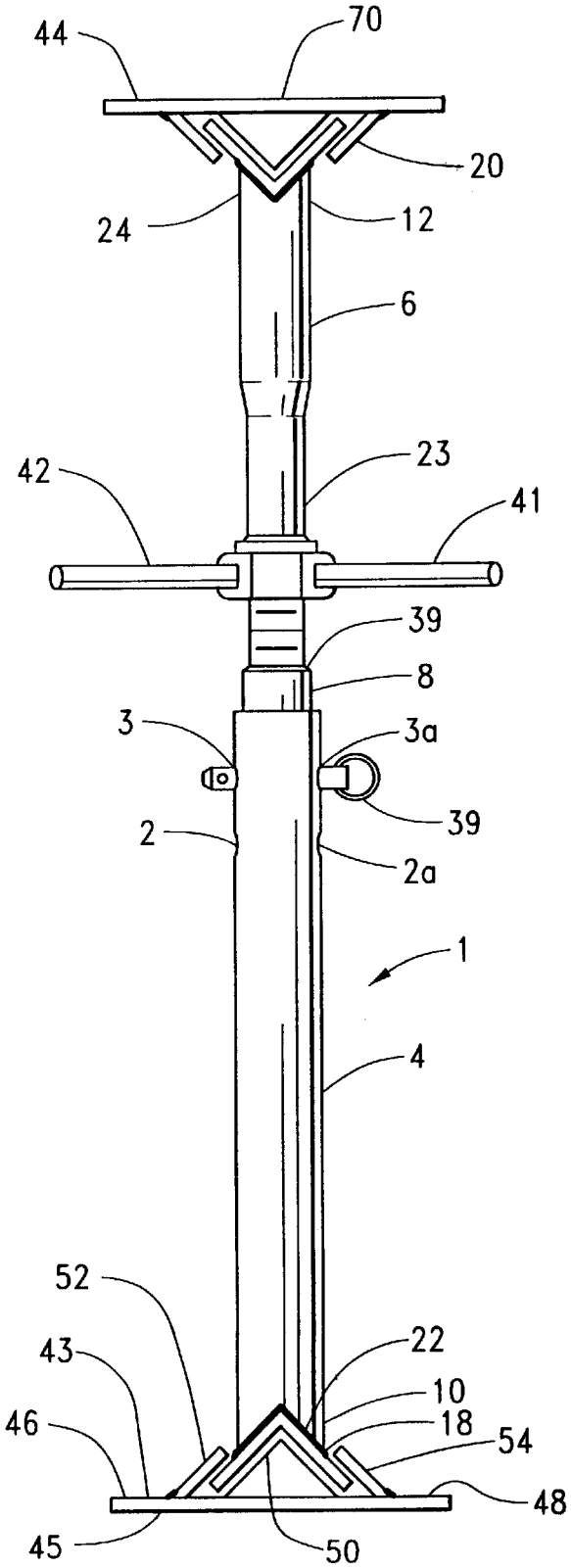
FIG. 1 is an outside view of an embodiment of the spreader of this invention.
Figure 2:
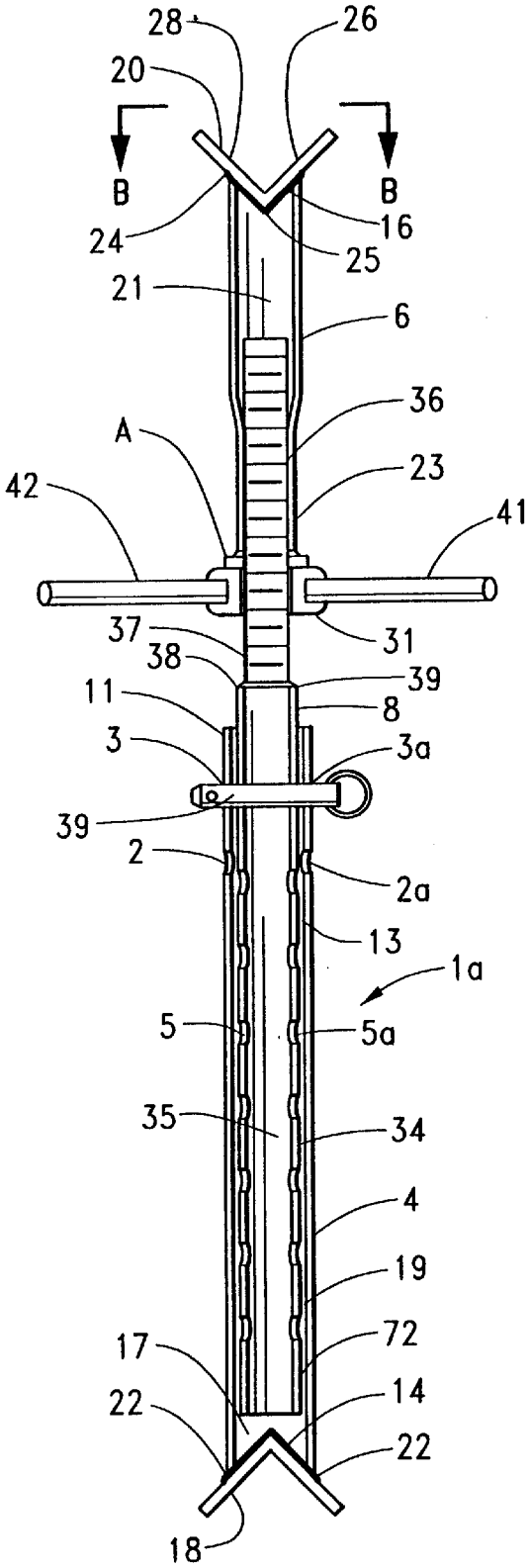
FIG. 2 is a cross-sectional view taken along the longitudinal axis of a preferred embodiment of the spreader of this invention. The embodiment shown in FIG. 2 is a variation of the embodiment shown in FIG. 1.

Referring now to the drawings, the spreader of this invention is generally designated by the numeral 1 in FIG. 1 and the numeral 1*a* in FIG. 2. FIG. 1 is an exterior view of one embodiment of the invention. FIG. 2 is a cross-sectional view of a variation of the embodiment shown in FIG. 1 taken along the longitudinal axis of the spreader of this invention. As shown in FIGS. 1 and 2, spreader 1 is comprised of stationary housing 4, traveling housing 6, and linear pressure transmission member 8. It is noted that the words "stationary" and "traveling," as used in connection with housing elements 4 and 6, respectively, are employed to denote the linear motion of elements 4 and 6 relative to element 8 during the use of spreader 1 to apply pressure to opposing objects.

Stationary housing 4 is a cylindrical tube having a hollow interior 13, a distal end 10 and an open proximal end 11. Distal end 10 comprises a concave shaped cut 14 which is adapted to conform to the shape of linear angle member 18 whereby cut 14 receives and contacts the exterior surface of angle member 18. Angle 18 is rigidly attached to cut 14, such as by weld bead 22. Vertex 19 of angle 18 is positioned in cut 14 along the diameter and perpendicular to the longitudinal axis of housing 4. The sides 15 and 17 of angle 18 and the ends of angle 18 preferably extend beyond the exterior surface of housing 4.

It is preferable, as shown in FIGS. 1 and 2, that the radius of housing 4 is constant from distal end 10 to proximal end 11; that cut 14 is V-shaped; and that angle 18 serves to close the distal end 10 of housing 4.

Holes 2 and 2*a* and 3 and 3*a* penetrate the wall of housing 4 near proximal end 11. Holes 2 and 2*a* are positioned at opposite ends of diameter 2-2*a* of housing 4 and holes 3 and 3*a* are positioned at opposite ends of diameter 3-3*a* of housing 4. Diameters 2-2*a* and 3-3*a* are longitudinally spaced apart and are shown to be, but are not required to be, positioned in the same plane.

Traveling housing 6 is a cylindrical tube having a hollow interior 21, a distal end 12 and an open proximal end 23. Distal end 12 comprises a concave shaped cut 16 which is adapted to conform to the shape of linear angle member 20 whereby cut 16 receives and contacts the exterior surface of angle member 20. Angle 20 is rigidly attached to cut 16, such as by weld bead 24. Vertex 25 of angle 20 is positioned in cut 16 along the diameter and perpendicular to the longitudinal axis of housing 6. The sides 26 and 28 of angle 20 and the ends of angle 20 preferably extend beyond the exterior surface of housing 6.

It is preferable, as shown in FIGS. 1 and 2, that cut 16 is V-shaped and that angle 20 serves to close the distal end 12 of housing 6.

As shown in FIGS. 1 and 2 the diameter of distal end 12 of housing 6 is greater than the diameter of proximal end 23. As will be described below, the diameter of proximal end 23 is related to the diameter of element 8 and, for purposes of convenience in use, the diameter of distal end 12 is preferably equal to the diameter of housing 4.

Figure 3:
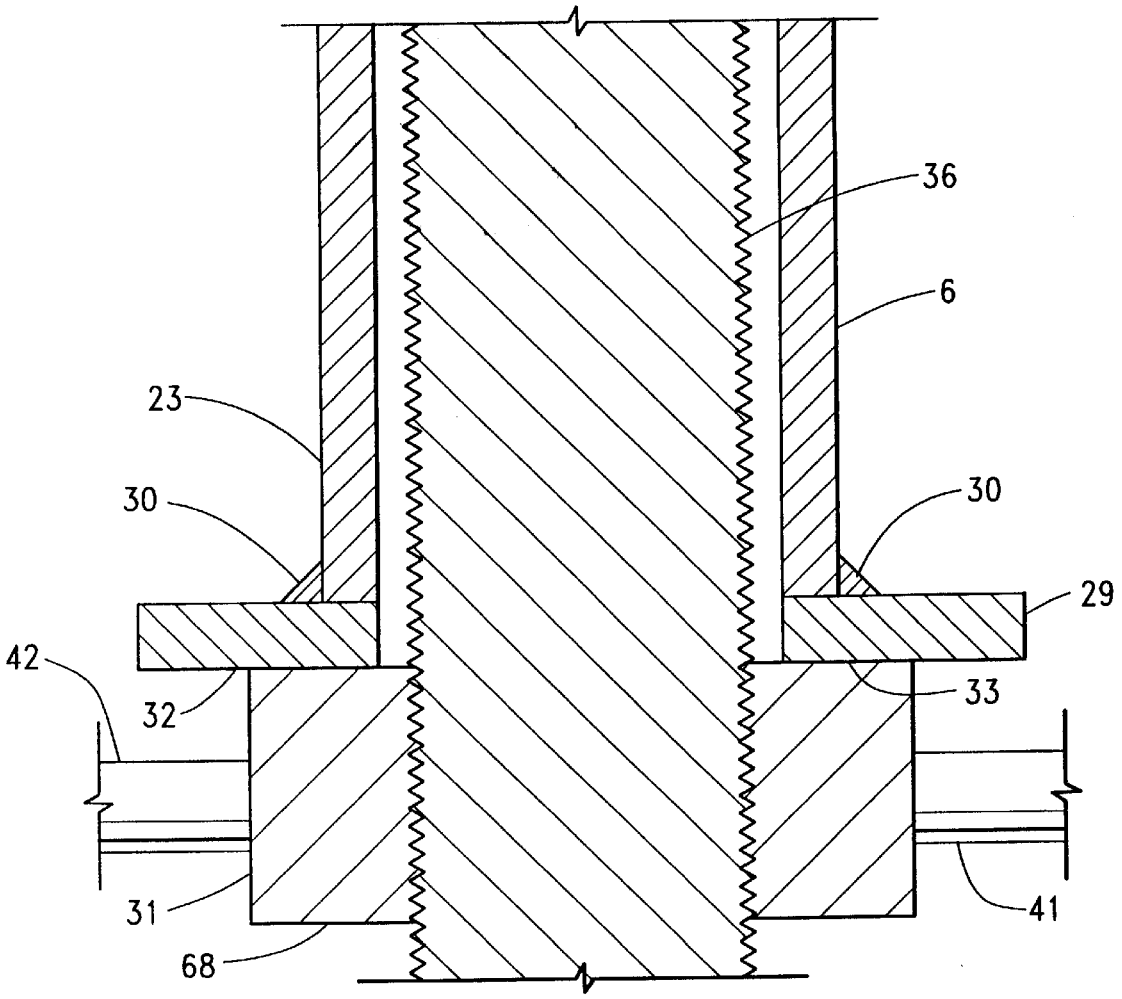
FIG. 3 is an enlarged view of the portion of FIG. 2 which is encircled and designated by the letter "A."

FIG. 3 is an expanded view of FIG. 2 within the circled area designated by the letter A. It is seen in FIG. 3 that washer 29 is rigidly attached, as by weld bead 30, to the bottom surface of proximal end 23 to thereby form a flange at the proximal end 23 of housing 6. The longitudinal axis of washer 29 coincides with the longitudinal axis of housing 6. The inside diameter of washer 29 is equal to the inside diameter of housing 6 at proximal end 23 and the outside diameter of washer 29 is at least equal to, and preferably greater than, the diameter of force generating member 31, a threaded nut, which is described below. Note that the bottom surface 32 of washer 29 is in rotational and bearing contact with the top surface 33 of nut 31.

Linear pressure transmission member 8 is comprised of cylindrical tube 34 having a hollow interior 35 and cylindrical threaded solid member 36. The proximal end 37 of threaded member 36, sometimes referred to as the fixed end, is rigidly attached to the proximal end 38 of tube 34, such as by weld bead 39.

Tube 34 is slidably inserted into the hollow interior 13 of housing 4 and maintained therein by pin 39 which is further described below. It is, accordingly, apparent that the outside diameter of tube 34 is less than the inside diameter of housing 4. The distal end of threaded member 36, sometimes referred to as the free end, is slidably inserted into proximal end 23 of housing 6. Accordingly, the inside diameter of housing 6 at proximal end 23 is greater than the outside diameter of member 36. It is preferred, for purposes of convenience in use and manufacture of spreader 1, that the diameter of proximal end 23 of housing 6 is equal to the diameter of tube 34 of member 8.

Holes, such as holes 5 and 5*a*, penetrate the wall of tube 34. Holes 5 and 5*a* are positioned at opposite ends of diameter 5-5*a* of tube 34. As shown in FIG. 2, tube 34 is penetrated by many sets of holes, such as holes 5 and 5*a*, which, for the sake of brevity, are not specifically identified. The various sets of holes which penetrate tube 34 are longitudinally spaced apart and are shown to be, but are not required to be, positioned in the same plane. The function of pin 39 is to prevent linear, sliding movement between housing 4 and tubing 34. Pin 39 is shown to be performing the function by simultaneously penetrating housing 4 along diameter 3-3*a* and tube 34 along diameter 5-5*a*. It is plain that the distance which tube 34 penetrates into hollow interior 13 of housing 4 along the longitudinal axis of housing 4 is controlled by pin 39 which simultaneously passes through holes 2-2*a* or 3-3*a* in housing 4 and holes, such as 5-5*a*, in tube 34. The selection of holes in which to insert pin 39 to prevent linear movement between housing 4 and tube 34 is a matter of choice by the user of spreader 1 principally depending upon the distance between opposing objects to be contacted by angles 18 and 20 as described below.

The threads of nut 31 are compatible with the threads on solid member 36. Nut 31 is operably installed, i.e., threaded, on member 36 before the free end of member 36 is inserted into housing 6. The depth of penetration of member 36 into housing 6 is thus controlled by the position of nut 31 on threaded member 36 and contact between surfaces 32 and 33 as described above in connection with FIG. 3. Rotation of nut 31 on threaded member 36 generates (or diminishes) force exerted by surface 33 against surface 32, to thus cause relative linear motion between housing 6 and threaded member 36 whereby the distance between angle 18 and angle 20 increases or decreases depending upon the direction of rotation of nut 31. It follows that the distance between any opposing objects in compressive contact with angles 18 and 20 will also vary with rotation of nut 31.

Figure 4:
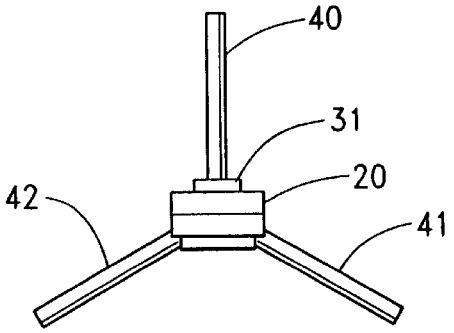
FIG. 4 is a top view of FIG. 2 taken in the direction of cut line B—B.

Although nut 31 may be rotated on member 36 by any of various well known manual and mechanical means, it has been found convenient to permanently attach rods 40, 41 and 42 to nut 31 to serve as handles to aid in the manual rotation of nut 31. For purposes of illustration, FIG. 4, taken in the direction of arrows B in FIG. 2, provides a top view of FIG. 2 wherein housing 6 is shown to be rotated 900 on surface 33 and nut 31 is a hexnut having 6 faces whereby rods 40, 41 and 42 extend radially outwardly from alternate faces of hexnut 31. In the embodiment shown in FIG. 4, rods 40, 41, and 42 lie in the same plane and are spaced 120° apart. The angular separation between rods 40, 41 and 42 as shown in FIG. 4 has been found to provide a convenient aid to manually rotate nut 31 on threaded member 36 to apply force against objects at distal ends 10 and 12 of spreader 1.

Pressure can be conveniently applied to objects having surfaces which are not planar by utilizing the embodiment shown in FIG. 2. An important illustration of the use of the embodiment of spreader 1 shown in FIG. 2 is provided below in Example 4 in connection with FIGS. 7, 8, 9 and 10.

Figure 5:
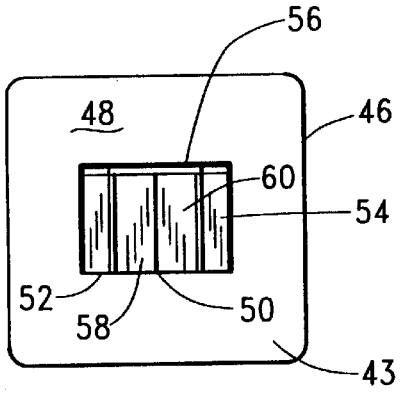
FIG. 5 is a plan view of the interior side of a plate element adapted to enable the spreader of this invention to conveniently engage a plane surface. The plate element is shown to be a part of the embodiment shown in FIG. 1.
Figure 6:
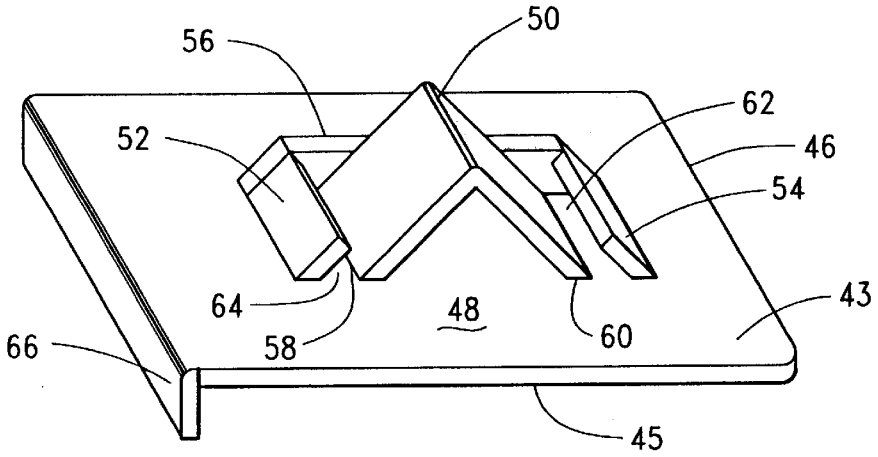
FIG. 6 is a 3-dimensional view of a variation of the plate element shown in FIG. 5.

Referring to FIG. 1, pressure plate 44 is shown installed on angle 20 and pressure plate 46 is shown installed on angle 18. Plates 44 and 46 are identical in all respects. Accordingly, the following description of plate 46 shall also serve as a description of plate 44. A plan view of plate 46 is shown in FIG. 5 and a variation of plate 46 is shown in FIG. 6 which is a 3-dimensional drawing. Thus, plate 46 is comprised of base 48, angle 50, rectangular side wall strip 52, rectangular side wall strip 54 and rectangular back wall strip 56. Angle 50, side wall 52, side wall 54 and back wall 56 are rigidly attached to front surface 43 of base 48. Back surface 45 of base 48 is a flat planar surface. In one preferred embodiment, base 48 is a regular rectangle. Functionally, Back surface 45 is used to contact and transmit force to an object and front surface 43 is used to contact angle 18.

Angle 50 is shaped to conform to the shape of angle 18 whereby the outside surface, i.e. the exposed surface, of angle 50 is enabled to contact the inside surface, i.e. the exposed surface, of angle 18. For example, if angle 18 is 90°, then angle 50 is preferably also 90°.

Angle 50 is preferably situated in the center of front surface 43 with the legs 58 and 60 of angle 50 being placed parallel to a side of base 48. Back wall 56 is placed perpendicular to front surface 43 and abuts the adjacent ends of legs 58 and 60 of angle 50. Back wall 56 is sufficiently long to extend beyond the respective lines of intersection of surface 43 and legs 58 and 60.

Side wall 54 abuts back wall 56 and is rigidly attached to surface 43 in a position spaced apart from leg 60. The plane surface of side wall 54 is positioned parallel to the plane surface of leg 60. Side wall 54 is preferably longer than angle 50. Back wall 56, side wall 54 and leg 60 thus cooperate to form slot 62.

In like manner, side wall 52 abuts back wall 56 and is rigidly attached to surface 43 in a position spaced apart from leg 58. The plane surface of side wall 52 is positioned parallel to the plane surface of leg 58. Side wall 52 is preferably longer than angle 50. Back wall 56, side wall 52 and leg 58 thus cooperate to form slot 64.

In the variation shown in FIG. 6, pressure plate 46 also includes shoulder wall 66 which is perpendicularly attached to back surface 45 of base 48 along an edge thereof and preferably parallel to the longitudinal axis of angle 50.

As shown in FIG. 1, plates 46 and 44 are mated to spreader 1. In this regard slots 62 and 64 of pressure plate 46 are adapted to receive legs 15 and 17, respectively, of angle 18. Similarly, slots of pressure plate 44 are adapted to receive legs 26 and 28 of angle 20.

Operation of Invention

Spreader 1 is useful to apply spreading forces to a pair of immediately adjacent, vertically separated, opposed objects as well as to a pair of immediately adjacent, horizontally separated, opposed objects. Either one or each of the adjacently opposed objects can be movable. The operation of the invention in terms of the relationship of objects to be spread and in terms of the stationary or movable status of the objects is illustrated in the following examples.

EXAMPLE 1

The embodiment of the spreader of this invention depicted in FIG. 1 is particularly useful to perpendicularly lift and/or lower a movable object having a plane surface with respect to an immovable object such as stationary ground.

Spreader 1 is prepared for use by rotating nut 31 until bottom surface 68 of nut 31 contacts, or at least closely approaches, weld bead 39 at the junction of cylindrical tube 34 and cylindrical threaded solid member 36. Plates 44 and 46 are then mated to angles 18 and 20 as previously described. Thereafter spreader 1 is placed between the objects to be spread apart and back surface 45 of pressure plate 46 is placed on a stable, preferably immovable, plane surface, such as the ground, situated vertically below an object to be moved (lifted, or lowered) relative to the ground. At that point pin 39 is removed from spreader 1 and member 8 is manually vertically moved until back surface 70 of plate 44 contacts the object to be moved. Thereafter, member 8 is slowly lowered into housing 4 until one of holes 2-2*a* or 3-3*a* is in registry with one of (various) holes 5-5*a* in tube 34. Pin 39 is then inserted through housing 4 and tube 34 by way of the registered holes to thereby immobilize member 8 with respect to housing 4. It will be understood that lowering member 8 for the purposes of inserting pin 39 will result in surface 70 breaking contact with the object to be, for example, lifted.

Then, while manually supporting spreader 1 in vertical position between the ground and the object to be lifted, housing 6 is manually raised until surface 70 contacts the object to be lifted. At that point nut 31 is spun, i.e. rapidly turned, on threaded member 36 until surface 33 contacts surface 32. Upon contact, rotation of nut 31 is continued with the aid of handles 40, 41 and 42 to apply forces to the object to be lifted and the immovable ground to thereby lift the object.

Comment

In Example 1, spreader 1, as shown in FIG. 1, is employed to vertically lift an object with respect to ground.

EXAMPLE 2

The embodiment of spreader 1, as shown in FIG. 1, can also be used, as illustrated in this Example 2, to spread horizontally spaced objects each of which is movable. The spreading of such objects can be more conveniently achieved by use of the version of plates 44 and 45 as shown in FIG. 6.

A pair of immediately adjacent, horizontally separated, opposed beams, such as spaced joists in the roof system of a building (for convenience referred to as joist A and joist B), can be forced apart to a desired separation. In this regard, shoulder wall 66 of plate 46 is placed in contact with the top horizontal surface of joist A so that back surface 45 contacts the vertical surface of joist A which faces the vertical surface of adjacent joist B. Angle 18 is mated to plate 46 and plate 44 is mated to angle 20, as previously described. Then, while manually horizontally supporting spreader 1 between joist A and joist B, tube 34 is immovably fixed in housing 4, also as previously described. Housing 6 is then manually linearly moved relative to member 36 until surface 70 contacts the vertical surface of joist B which faces the vertical surface of adjacent joist A and shoulder wall 66 of plate 44 contacts the top horizontal surface of joist B. Nut 31 is then spun as previously described until surface 33 contacts surface 32. Thereafter, nut 31 is rotated with the assistance of handles 40, 41 and 42 until joists A and B are forced to a desired separation. At this point, a permanent brace or bridging can be placed between joist A and joist B to maintain the desired separation and spreader 1 can be removed by counter rotation of nut 31.

EXAMPLE 3

A variation of the embodiment of the spreader of this invention shown in FIG. 2 was constructed. The variation constructed did not have stationary housing 4 and did not have holes 2, 2*a*, 3, 3*a*, 5 and 5*a*. In this variation, the spreader did have linear pressure transmission member 8 wherein angle 18 was attached to distal end 72 of cylindrical tube 34 in the manner previously described for attachment of angle 18 to distal end 10 of housing 4.

In this variation, member 8 had a total length of 27¾ inches, cylinder 34 was a steel tube having a total length of 20 inches and threaded member 36 was a threaded steel rod 7¾ inches long having an outside diameter of 1⅛ inches. Furthermore, the diameter of member 34 was not uniform. Accordingly, the distal end 72 of cylinder 34, attached to angle 18 was 16½ inches long, had an outside diameter of 1⅝ inches and a wall thickness of 1/16 of an inch. The proximal end of cylinder 34, rigidly attached to the fixed end of threaded member 36, was 3½ inches long, had an outside diameter of 1 9/16 inches and a wall thickness of 1/16 of an inch.

Angle 18 was a 3/16 inch 90° structural steel member having two 1¼ inch legs and a length of 2⅛ inches.

Traveling housing 6 was a steel tube having a wall thickness of 1/16 of an inch and a length of 9 inches. The distal end had an outside diameter of 1 5/8 inches and the proximal end had an outside diameter of 1 9/16 inches. Angle 20 was a 3/16 inch 90° structural steel member having two 1 1/4 inch legs and a length of 2 1/8 inches. The terminal end of proximal end 23 was flared to form a 2 5/16 inch outside diameter flange for contacting nut 31.

Nut 31 was a 1 1/8 inch inside diameter hexnut having an outside diameter of 2 1/8 inches and threads compatible with the threads of member 36. Each alternate face of hexnut 31 had rigidly attached thereto and extending radially outwardly therefrom a 5 1/2 inch long, 1/2 inch diameter steel rod.

EXAMPLE 4

The spreader described in Example 3 was used to aid in the removal of transmission cases from several DODGE pick-up trucks of model years 1993 and later.

Figure 7:
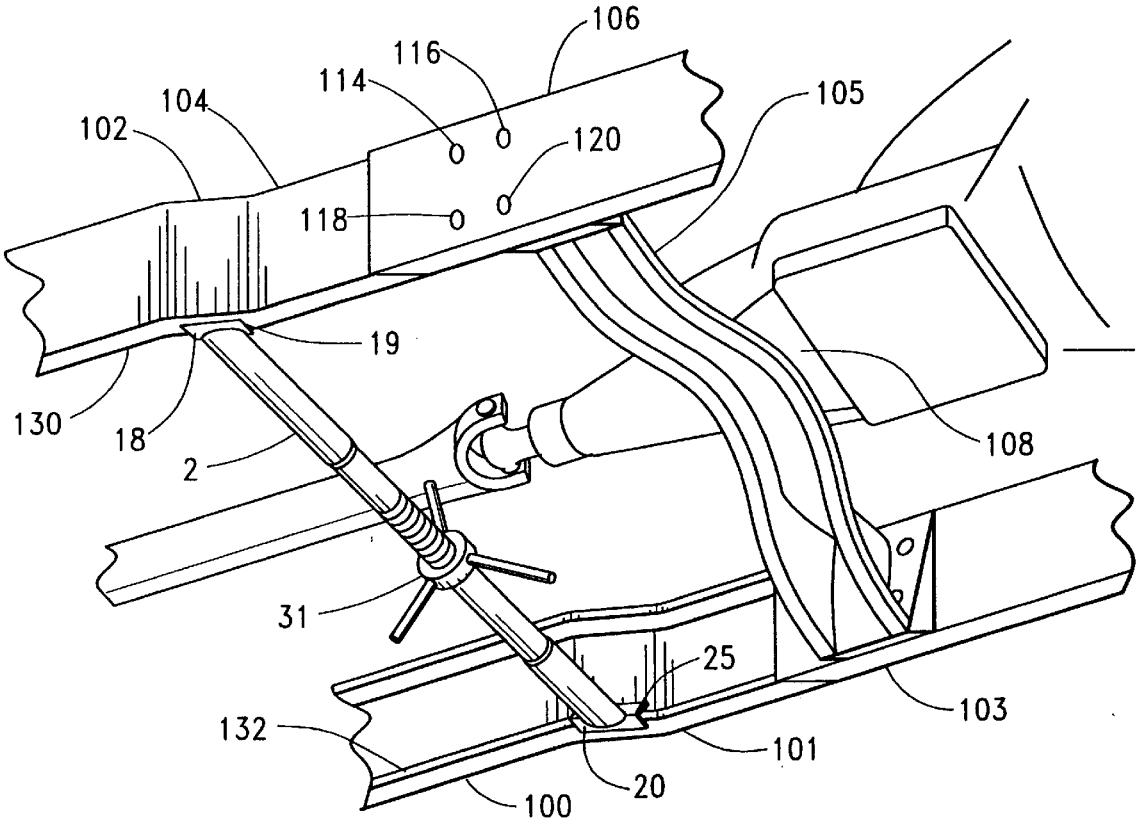
FIG. 7 is 3-dimensional drawing of a portion of the underside of a vehicle showing the spreader of this invention depicted in FIG. 2 installed between the frame rails of the vehicle.
Figure 8:
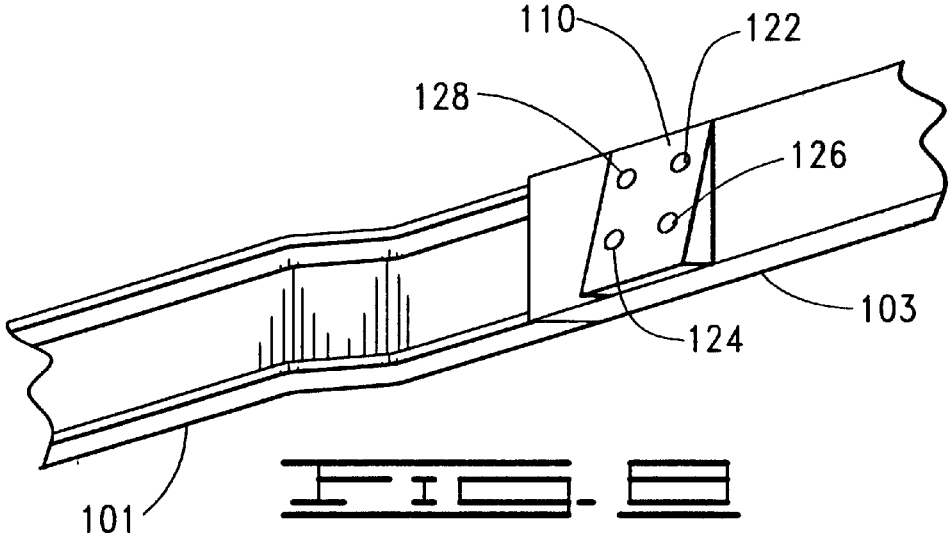
FIG. 8 is a 3-dimensional detail view of the interior portion of a frame rail of the vehicle shown in FIG. 7.
Figure 9:
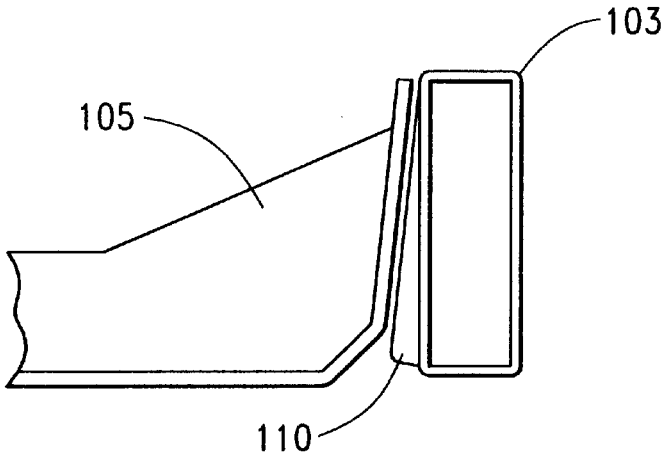
FIG. 9 is a transverse cross-sectional view of the vehicle rail shown in FIG. 7 and FIG. 8.
Figure 10:
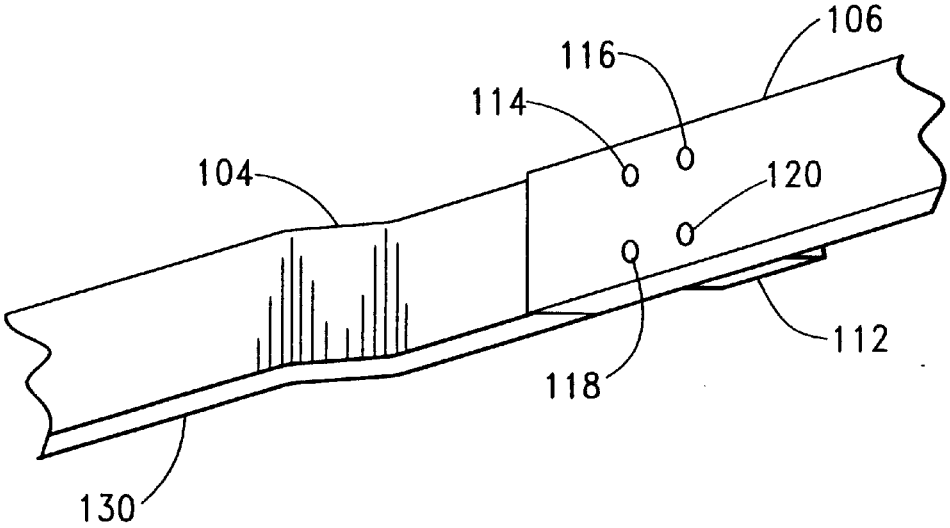
FIG. 10 is a 3-dimensional detail view of the exterior portion of the frame rail of the vehicle shown in FIG. 7. The rail shown in FIG. 10 is opposite the rail shown in FIG. 8.

Referring now to FIGS. 7, 8, 9 and 10, and particularly to FIG. 7, a portion of the bottom side of a typical DODGE pick-up truck of the indicated model years is shown. In a schematic representation, brace 105 is shown to be situated between frame rail 100, consisting of segments 101 and 103, and frame rail 102, consisting of segments 104 and 106. As shown in FIGS. 7, 8, 9 and 10, brace 105 is specifically shown to be wedged between shim 110 of segment 103 and shim 112 of segment 106 and attached thereto by bolts, which are not shown.

Transmission case 108 is shown to be positioned between segment 103 and segment 106 and above brace 105. To remove transmission case 108 it is required to first remove brace 105.

To remove brace 105, bolts, not shown, fastening brace 105 to shims 110 and 112 are first removed from bolt holes 114, 116, 118 and 120 of shim 112 and frame rail segment 106 and bolt holes 122, 124, 126 and 128 of shim 110 and frame rail segment 103.

The spreader of Example 3 was positioned between frame rail segments 104 and 101 wherein lower flange 130 of segment 104 was positioned within the interior of angle 18 against vertex 19, and lower flange 132 of segment 101 was positioned within the interior of angle 20 against vertex 25. Thus, angle 18, as previously described, was positioned against flange 130 then, while manually horizontally supporting spreader between segment 104 and segment 101, traveling housing 6 was slid over threaded member 36 until flange 132 was within angle 20 and contacted vertex 25, then nut 31 was spun on threaded member 36 until surface 33 of nut 31 contacted surface 32 of washer, i.e., flange, 29.

Thereafter, nut 31 was rotated with the assistance of handles 40, 41 and 42 to generate a spreading force necessary to cause frame rails 100 and 102 to spread by an amount sufficient to enable brace 105 to release from the wedging action of shims 110 and 112.

At this point, brace 105 was removed to enable transmission case 108 to be lowered from the bottom of the truck by well known and conventional steps. Replacement of transmission case 108 and brace 105 was accomplished by reversal of the steps described above.

Having described the invention, that which is claimed is:

1. An apparatus for increasing the linear separation between a first object and a second object:

said apparatus is an elongated structure comprising a first end member, a second end member, a linear pressure transmission member and a force generating member;

said first end member is comprised of at least one linear tubular member having a hollow interior, a primary distal end and a primary proximal end, wherein said primary distal end of said first end member is adapted to contact and transmit compressive force to said first object;

said second end member is comprised of a traveling housing having a hollow interior, a first distal end adapted to contact and transmit compressive force to said second object and a flanged first proximal end adapted to slidably contain said linear pressure transmission member;

said linear pressure transmission member is positioned intermediate said first end member and said second end member and is comprised of a solid threaded rod having a free end and a fixed end, wherein said fixed end of said linear pressure transmission member is rigidly connected to said primary proximal end of said first end member to prevent motion between said first end member and said linear pressure transmission member and to enable said linear pressure transmission member to transmit compressive force to said first end member, and said free end of said linear pressure transmission member is positioned in linear slidable relation in said hollow interior of said second end member;

said force generating member has a top surface and a bottom surface and is rotationally connected to said linear pressure transmission member intermediate said first end member and said second end member to enable simultaneous linear and rotational motion of said force generating member relative to said linear pressure transmission member, said top surface of said force generating member is adapted to permit rotational contact against said flanged proximal end of said second end member to enable said force generating member to transmit compressive force to said second end member.

2. The apparatus of claim 1 wherein said force generating member is a nut having threads compatible with said threaded rod.

3. The apparatus of claim 2 wherein said nut is a hexnut having six exterior surfaces, wherein a rigid rod is fixed to and extends radially outwardly from each alternating exterior surface of said hexnut.

4. The apparatus of claim 1 wherein said first end member consists of two of said linear tubular members comprised of a hollow tubular member, having a second distal end and a second proximal end, slidably inserted and adjustably fixed in the interior of a hollow stationary housing, having a third distal end and a third proximal end, to thereby prevent relative linear motion between said hollow tubular member and said hollow stationary housing;

said fixed end of said linear pressure transmission member is rigidly connected to said second proximal end of said hollow tubular member to thereby prevent motion between said first end member and said linear pressure transmission member; and said third distal end of said stationary housing is adapted to contact and transmit compressive force to said first object.

5. The apparatus of claim 4 wherein said force generating member is a nut having threads compatible with said threaded rod.

6. The apparatus of claim 5 wherein said nut is a hexnut having six exterior surfaces, wherein a rigid rod is fixed to and extends radially outwardly from each alternating exterior surface of said hexnut.

7. An apparatus for increasing the linear separation between a first object and a second object:

said apparatus is an elongated structure comprised of a hollow traveling housing having a first distal end and a first flanged proximal end, a tubular member having a second distal end and a second proximal end, a threaded rod having a free end and a fixed end, and a nut having threads compatible with said threaded rod;

said threaded rod is positioned intermediate said hollow traveling housing and said tubular member wherein said fixed end of said threaded rod is rigidly connected to said second proximal end of said tubular member to thereby enable said threaded member to transmit compressive force to said tubular member, and said free end of said threaded rod is slidably inserted into said first flanged proximal end of said hollow traveling housing;

said nut is threaded on said threaded rod intermediate said hollow traveling housing and said tubular member and said nut is adapted to contact and rotate against said first flanged proximal end of said hollow traveling housing to thereby permit said nut to transmit compressive force against said hollow traveling housing.

8. The apparatus of claim 7 wherein said first distal end of said hollow traveling housing is adapted to transmit compressive force to said first object and said second distal end of said tubular member is adapted to transmit compressive force to said second object.

9. The apparatus of claim 8 wherein said nut is a hexnut having six exterior surfaces, wherein a rigid rod is fixed to and extends radially outwardly from each alternating exterior surface of said hexnut.

10. An apparatus for increasing the linear separation between a first object and a second object:

said apparatus is an elongated structure comprised of a hollow traveling housing having a first distal end and a first flanged proximal end, a linear member comprised of a hollow tubular member, having a second distal end and a second proximal end, slidably inserted and adjustably fixed in the interior of a hollow stationary housing, having a third distal end and a third proximal end, to thereby prevent relative linear motion between said hollow tubular member and said hollow stationary housing, a threaded rod having a free end and a fixed end, and a nut having threads compatible with said threaded rod;

said threaded rod is positioned intermediate said hollow traveling housing and said hollow tubular member wherein said fixed end of said threaded rod is rigidly connected to said second proximal end of said hollow tubular member to thereby enable said threaded member to transmit compressive force to said linear member, and said free end of said threaded rod is slidably inserted into said first flanged proximal end of said hollow traveling housing;

said nut is threaded on said threaded rod intermediate said hollow traveling housing and said tubular member and said nut is adapted to contact and rotate against said first flanged proximal end of said hollow traveling housing to thereby permit said nut to transmit compressive force against said hollow traveling housing.

11. The apparatus of claim 10 wherein said first distal end of said hollow traveling housing is adapted to transmit compressive force to said first object and said third distal end of said hollow stationary housing is adapted to transmit compressive force to said second object.

12. The apparatus of claim 11 wherein said nut is a hexnut having six exterior surfaces, wherein a rigid rod is fixed to and extends radially outwardly from each alternating exterior surface of said hexnut.

* * * * *